US009826827B2

(12) United States Patent
Calderone

(10) Patent No.: US 9,826,827 B2
(45) Date of Patent: Nov. 28, 2017

(54) BED TABLE RETRACTABLE TO BE CONCEALED ADJACENT A BED RAIL

(71) Applicant: Joel Calderone, Long Beach, CA (US)

(72) Inventor: Joel Calderone, Long Beach, CA (US)

( * ) Notice: Subject to any disclaimer, the term of this patent is extended or adjusted under 35 U.S.C. 154(b) by 115 days.

(21) Appl. No.: 14/845,552

(22) Filed: Sep. 4, 2015

(65) Prior Publication Data

US 2016/0058177 A1 Mar. 3, 2016

Related U.S. Application Data

(63) Continuation-in-part of application No. 14/258,283, filed on Apr. 22, 2014, now Pat. No. 9,345,320.

(51) Int. Cl.

| | |
|---|---|
| ***A47B 23/02*** | (2006.01) |
| ***A47B 23/00*** | (2006.01) |
| ***A47C 21/00*** | (2006.01) |
| ***A47B 3/00*** | (2006.01) |

(52) U.S. Cl.

CPC ..... *A47B 23/025* (2013.01); *A47B 3/002* (2013.01); *A47B 23/02* (2013.01); *A47C 21/00* (2013.01)

(58) Field of Classification Search

CPC ..... A47C 21/00; A47C 31/00; A47C 7/70; A47C 7/68; A47C 7/62; A61G 7/05; A61G 7/0503; A47B 23/00; A47B 23/02; A47B 23/025; A47B 23/046; F16M 13/02; F16M 13/00; F16M 11/10; F16M 11/06; F16M 11/04

USPC ..... 5/507.1, 503.1–506.1, 658; 108/49, 42; 297/144, 145

See application file for complete search history.

(56) References Cited

U.S. PATENT DOCUMENTS

| | | | | |
|---|---|---|---|---|
| 1,208,979 | A | 12/1916 | Kahre | |
| 1,231,678 | A | 7/1917 | Walker | |
| 1,862,237 | A | 6/1932 | Pepler | |
| 2,612,422 | A | 9/1952 | Sarkus | |
| 3,543,312 | A | 12/1970 | Pofferi | |
| 3,618,145 | A | 11/1971 | Rower | |
| 5,035,434 | A | 7/1991 | Taylor | |
| 5,035,464 | A | 7/1991 | Spallholtz | |
| 5,038,434 | A * | 8/1991 | Navarrette | A47B 23/025 108/49 |
| 5,144,898 | A * | 9/1992 | Posly | A47B 23/046 108/148 |
| 5,293,825 | A * | 3/1994 | Cauffiel | A47B 23/02 108/42 |
| 5,479,865 | A * | 1/1996 | Cauffiel | A47B 23/02 108/42 |
| 5,606,917 | A * | 3/1997 | Cauffiel | A47B 23/02 108/42 |
| 5,606,918 | A * | 3/1997 | Cauffiel | A47B 23/02 108/42 |
| 7,234,182 | B2 | 6/2007 | Miller et al. | |
| 9,345,320 | B2 * | 5/2016 | Calderone | A47B 23/025 |
| 2006/0085917 | A1 | 4/2006 | Miller | |
| 2015/0296977 | A1 | 10/2015 | Calderone | |

(Continued)

*Primary Examiner* — Robert G Santos

(74) *Attorney, Agent, or Firm* — Fulwider Patton LLP

(57) ABSTRACT

Elongated vertical stem to pivotally attached on one extremity to the frame of the sofa arm rest and pivotally mounting a table on the free extremity for rotating between a retracted position disposed in the extended plane of the stem and a working position perpendicular to the plane of the stem.

13 Claims, 11 Drawing Sheets

(56) References Cited

U.S. PATENT DOCUMENTS

| | | | | |
|---|---|---|---|---|
| 2016/0000222 | A1 | 1/2016 | Calderone | |
| 2016/0058177 | A1 * | 3/2016 | Calderone | A47B 23/025 5/507.1 |

* cited by examiner

FIG. 14
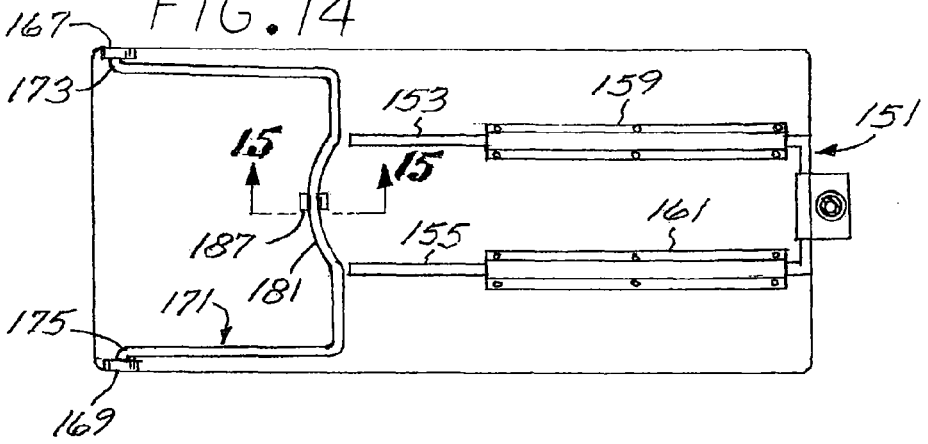
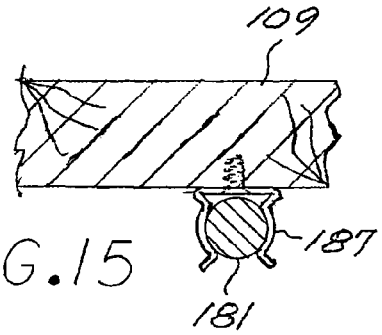
FIG. 15
FIG. 16
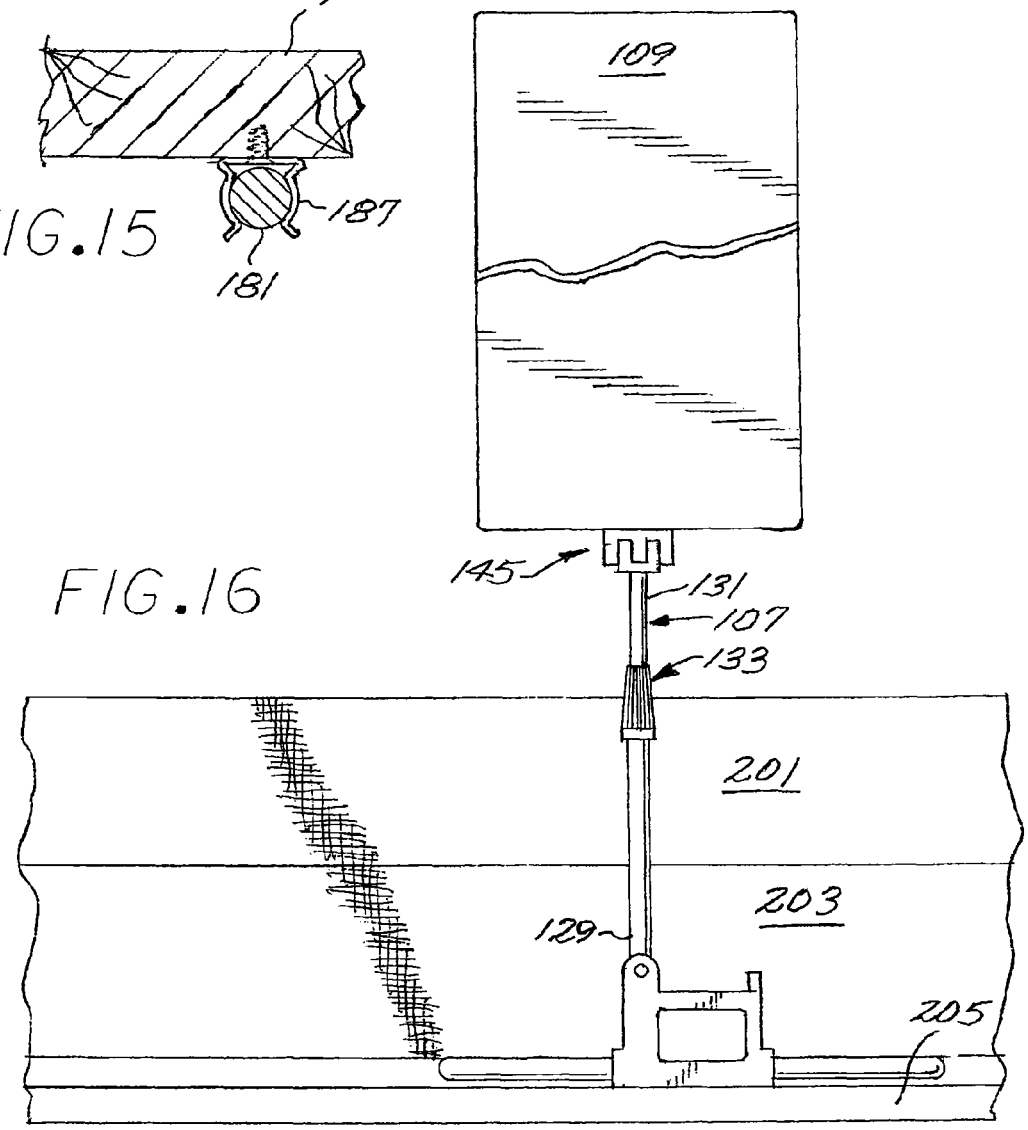

BED TABLE RETRACTABLE TO BE CONCEALED ADJACENT A BED RAIL

CROSS-REFERENCE TO RELATED APPLICATIONS

This application is a continuation in part of co-pending U.S. Ser. No. 14/258,283 filed Apr. 22, 2014, the entire contents of which are incorporated by reference herein and priority is claimed thereto.

BACKGROUND

The present invention relates to a retractable table for mount to a bed or the like.

DESCRIPTION OF THE PRIOR ART

Numerous different devices have been proposed for supporting a snack tray or the like for access by a user sitting on a sofa, easy chair or lying in bed. It has been proposed to provide a slider track under a sofa for supporting a lever arm to be slid out from underneath the frame. The arm carries on its distal end a specialized ball joint so a support arm can be swiveled from a horizontal to a vertical position, the support arm further including a ball joint at the top extremity to support a folding tray. The lever arm may thus be slid outwardly and the support arm raised to support the tray in its working position. For storage, the arms may then be folded on one another and the tray folded to be recessed beneath the sofa frame. A device of this type is shown in U.S. Pat. No. 5,035,464 to Spallholtz. Such devices are of rather complex construction, relatively expensive to manufacture and subject to challenges in operation and, furthermore, leave the table exposed underneath the sofa for viewing by family members and guests and exposed to unsanitary conditions.

An accepted approach in the art has been to employ support devices incorporating a foot like extension to hook underneath the front or side edge of a chair. Devices of this type are shown in U.S. Pat. No. 3,717,375 to Sloboden. U.S. Pat. No. 8,113,128 to Lee and U.S. Patent Application Publication No. 2014/0020605 to Barrie. Such devices have not generally gained favor in the marketplace due to the fact that they leave the tray exposed unless a storage closet or the like is convenient to the user when the device is not in use. Other efforts have led to the proposal that the support be supported from a journal installed beneath the support frame of a chair to rotate a table into position over the lap of the user. A device of this type is shown in U.S. Pat. No. 5,765,911 to Sorenson. Again, these devices then leave an unsightly mechanism exposed both when the table is in use and in storage.

SUMMARY OF THE INVENTION

The invention is in the form of a retractable table device for mounting adjacent a mattress of a bed to be retracted in the narrow space between the mattress and the bed support rail. A table is pivotally carried from the free end of the stem for rotation between an extended plane including the stem to a working position projecting perpendicular to the stem.

BRIEF DESCRIPTION OF THE DRAWINGS

FIG. 14 is a horizontal sectional view showing the bottom side of the table included in the device shown in FIG. 8;

FIG. 15 is a partial vertical, sectional view, in enlarged scale, taken along the line 15-15 of FIG. 7;

FIG. 16 is an end view of the retractable table device shown in FIG. 8 with the table rotated to its retracted position.

DETAILED DESCRIPTION OF THE PREFERRED EMBODIMENTS

Figure 1:
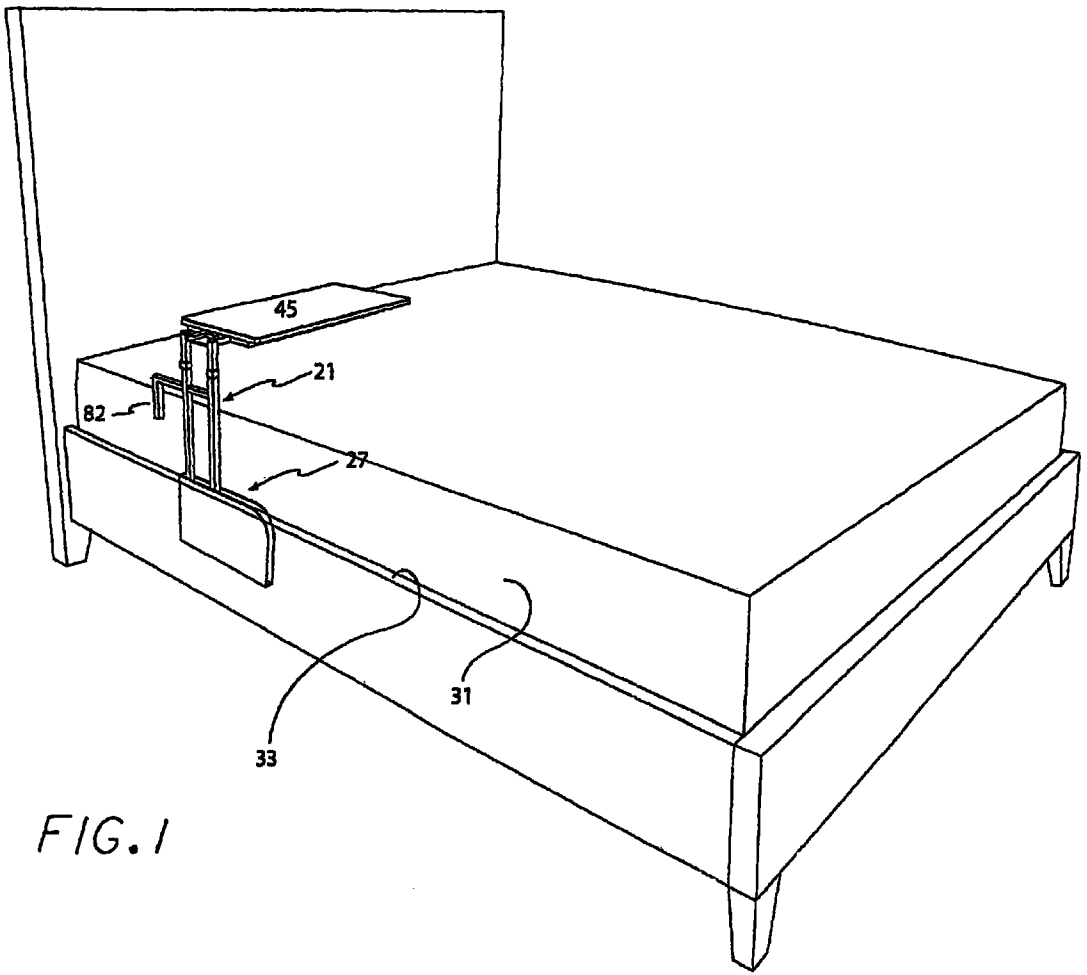
FIG. 1 is a perspective view of the retrofit table device of the present invention mounted to the space between a side of a mattress and the side rail of a bed.
Figure 2:
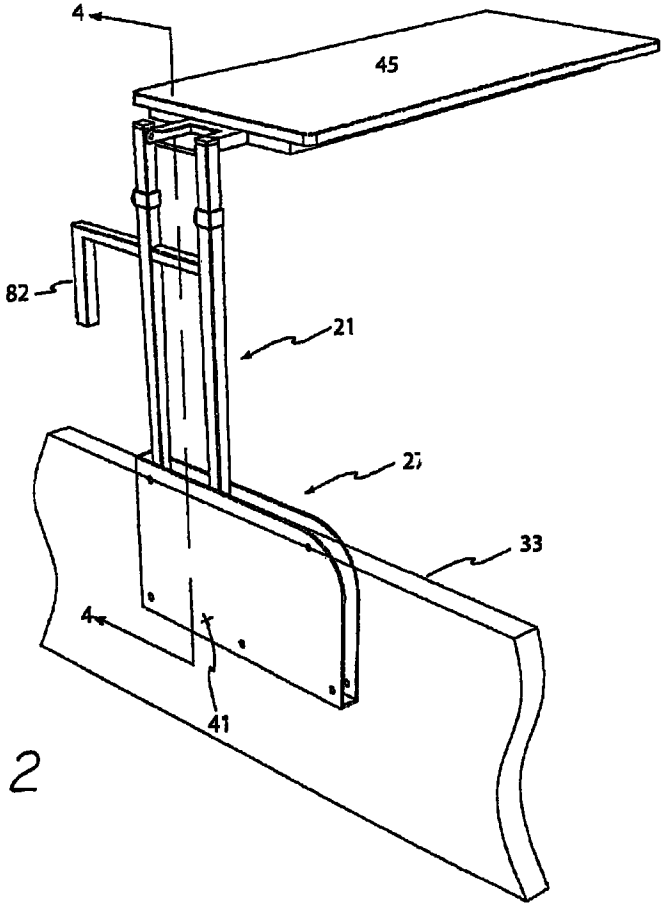
FIG. 2 is a partial perspective view similar to FIG. 1 but in enlarged scale.
Figure 3:
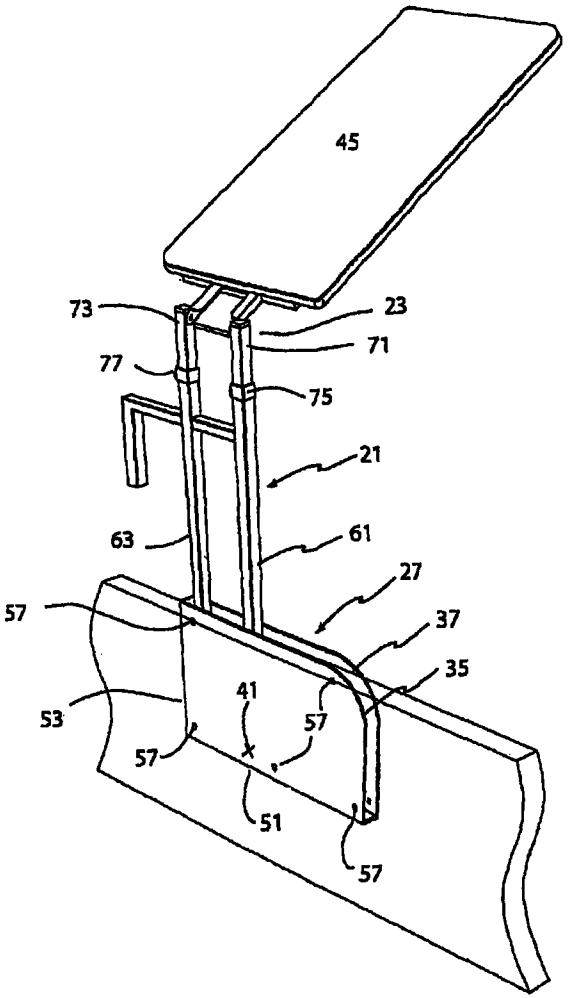
FIG. 3 is a sectional view taken in along the line of 33 of FIG. 2.

Referring to FIGS. 1 and 3, the retractable bed table device of the present invention includes, generally, an elongated stem or in the form of a stand 21 configured with upper and lower extremities 23 and 25. A base device in the form of narrow mounting box, generally designated 27, is fitted into the narrow space between the side of a cushion device like a mattress 31 and the inside surface of a frame member identified as a rail 33 and is configured with opposite side walls 35 and 37 to receive the stand in close fit relationship. The forward side of the stand 21 at the lower extremity is connected with the box 27 by means of a pivot pin 41 so that the stand may be pivoted between the lower position shown in FIG. 5 and the raised position shown in FIG. 1. A table top 45 is pivotally connected to the upper extremity 23 of such stand.

With the aging of the American population, the need for convalescence is expected to grow significantly in the coming years thus fueling an interest in devices making convalescence more comfortable the older population. Persons 65 years and older was counted at 40 million in 2009 representing almost 13% of the US population. By 2030 it is projected that there will be about 72 million older persons, more than twice the number in 2000. Thus it would be expected that there will be more convalescence with patients confined to a bed.

There are millions of conventional beds, as well as hospital beds presently in use which might be used for certain periods of time while patients are bedridden. While numerous devices have been proposed for use with beds of this type to facilitate serving meals to the patient and the like, to date none have been proposed which provide a convenient retrofit apparatus which can be inexpensively manufactured and conveniently installed in existing beds to provide a sturdy support for a table top which may be loaded with food and related materials having some significant weight and which are often loaded unevenly on the table top. It is this need for a device to retrofit beds to provide a convenient and sturdy mechanism for serving the patient's meals and the like which is solved by the present invention.

Figure 6:
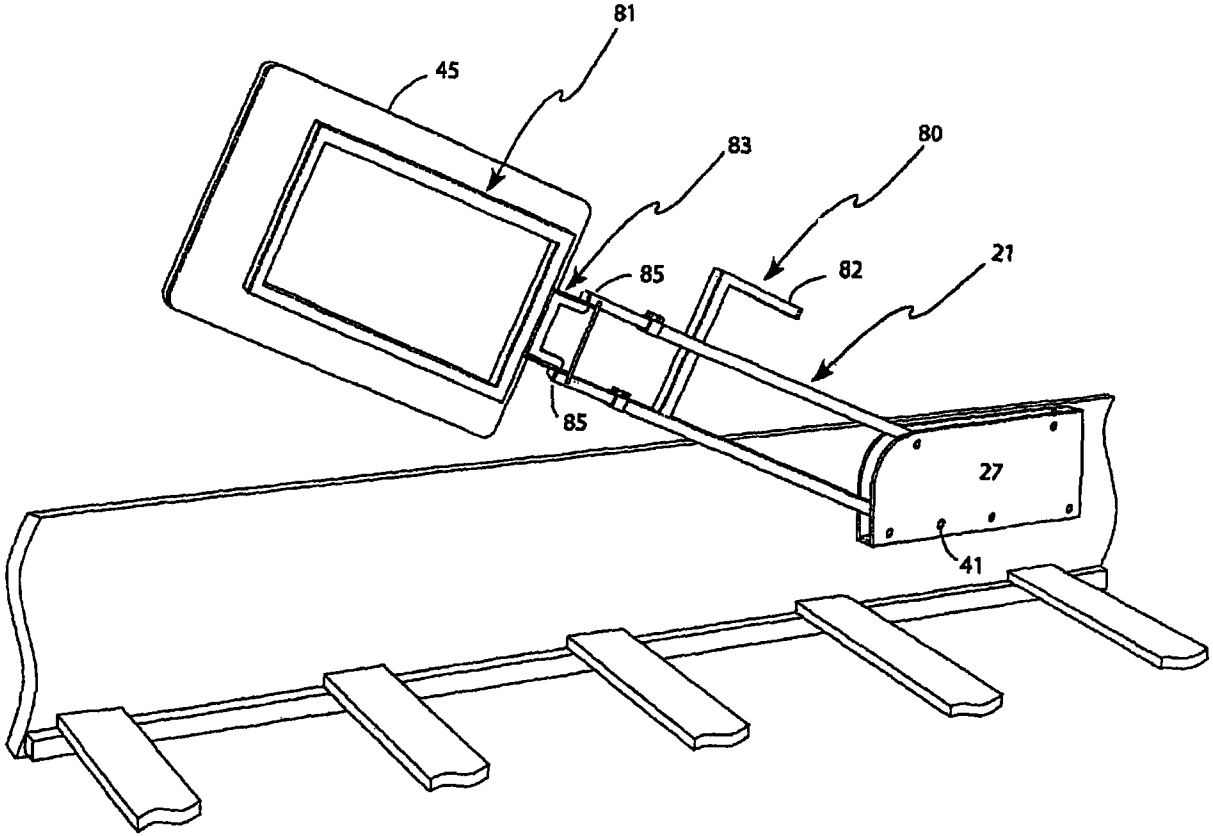
FIG. 6 is a sectional view similar to FIG. 5 but showing the table device in a partially raised position.

In one preferred embodiment, my device is constructed of metal or plastic or the like. Referring to FIGS. 1 and 6, the supporting device may be in the form of mounting box 27 conveniently formed of sheet metal or plastic and I have found that an overall depth of about 1¼ inches will conveniently fit in the space between the inside of the bed side rail surface 33 and side of the mattress 31 to provide for convenient installation and sturdy support. In practice, the box is approximately 10 inches high and 16 inches long to provide a relatively sturdy construction. I have found that a width of between ¾ and 1½ inch is sufficient to fit most commercially available beds and to provide the necessary clearance for free movement of the stand. In the preferred embodiment, the box is formed with a bottom wall 51 and front wall 53 to add rigidity to the box itself. The configuration of the side walls, bottom wall 51 and front wall 73 leaves the top side and rear side open.

Referring to FIG. 3, the walls of the box are formed with a plurality of through clearance bores for receipt of respective fasteners 57 to secure the back wall of such box securely to the bed side rail.

Figure 7:
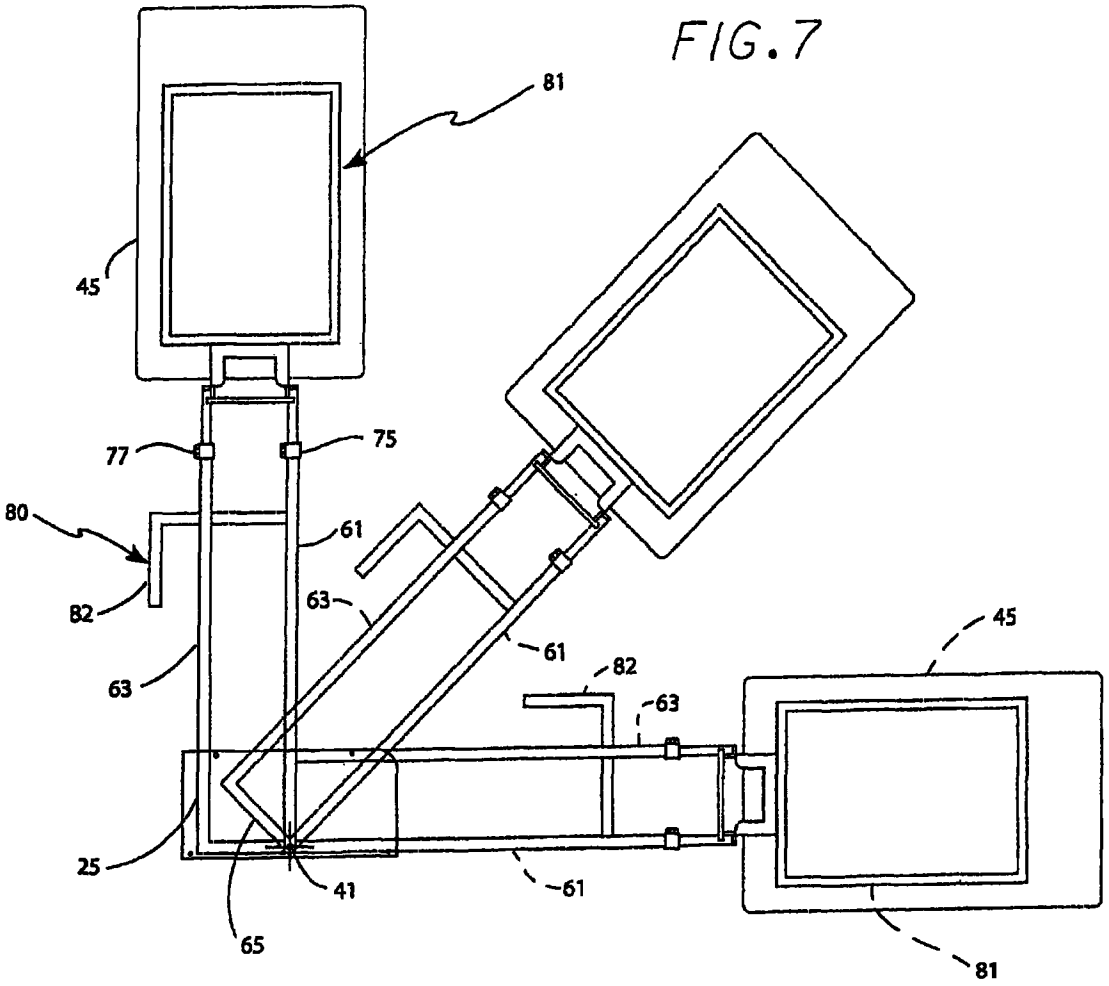
FIG. 7 is a partial sectional view similar to FIG. 6 and showing the table being raised from its retracted position to its erect position.

For this preferred embodiment, I have constructed my stand 21 with an adjusted height of between 2 and 3 feet and a width of approximately 7 inches to provide a sturdy support and a cooperative relationship with the box to afford extra support for the stand itself. For the preferred embodiment I have selected a pair of female square stem tubes 61 and 63 having a cross section of about 1 inch and a cross rung 65 connecting the lower ends of such tubes, the juncture between the rung 65 and tube 61 being configured with the pivot bore for receipt of the pivot pin 41 (FIG. 3). As will be appreciated by those skilled in the art, the stand 21 thus pivots about the pivot pin 41 as the opposite side of the stand at the end of the bottom rung 65 (FIG. 7) acts as a follower tracing a circular path having a diameter of about 7 inches as the stand is rotated between its lowered horizontal position to its erect position. In practice, I construct the mounting box with only about ⅛ inch space between the opposite sides of the stand 21 and the front and back walls 35 and 37 to thus provide for free rotation of the stand while affording positive support against the top of the stand tilting inwardly or outwardly from the erect position shown in FIG. 1, even as the top of the table 45 is loaded. Furthermore, in the erect position, the lateral extent of the stand supported in the box 27 provides support against twisting of the stand within the confines of the walls 35 and 37 to thereby prevent rotation of the table 45 in the horizontal plane even if the distal free end should be bumped (FIG. 1). In practice I have found that a clearance between the sides of the stand of between 1/32 of an inch and ⅜ of an inch serves to provide the necessary clearance for free rotation while affording the necessary support for the stand to prevent tilting and twisting under normal loads.

Referring to FIG. 3, I provide my stand 21 with a pair of square male tubes 71 and 73 telescoped downwardly into the female tubes 61 and 63 and configured so that the extent of telescoping thereof can be controlled by means of respective adjustable collars 75 and 77 which include thumb screw fasteners to adjust the compression thereof for controlling the relative movement of the extension tubes 71 and 73 relative to the female tubes 61 and 63

Referring to FIG. 6, in one preferred embodiment I provide a square tubular frame, joint designated 81 to support my table top 45. In this embodiment, I include a connector yoke, generally designated 83, which is connected with the upper extremities of the tubes of the stand by means of pivot pins 85 for rotation of the table top between its retracted position disposed in the extended plane of the stand and its work position as shown in FIG. 1. For this preferred embodiment, I have incorporated a handle 81 attached to the stand and configured in the form of a L-shaped crank formed of square tubing and configured with a handle 82.

In operation, it will be appreciated that the retrofit table top apparatus of the present invention can be conveniently packaged in a shipping package for inventorying by a retail outlet or shipping to customers of a website and upon receipt, the installation will be relatively straightforward. As an example, the apparatus may be retrofitted to a bed by merely positioning the mounting box 27 on the inside surface 33 of the bed rail and positioned forwardly or rearwardly along the rail to the location most convenient to the patient intended to rest on the mattress 31. Fasteners may then be inserted through the pre-drilled bores 57 in the box 27 to secure the box in position on the rail and oriented with the open sides facing upwardly and rearwardly. The table 45 will then be in position for ready use or storage, supported in its raised position against the top of the stand 21 tipping inwardly as the table is loaded and against twisting should the free end of the table be bumped.

Figure 5:
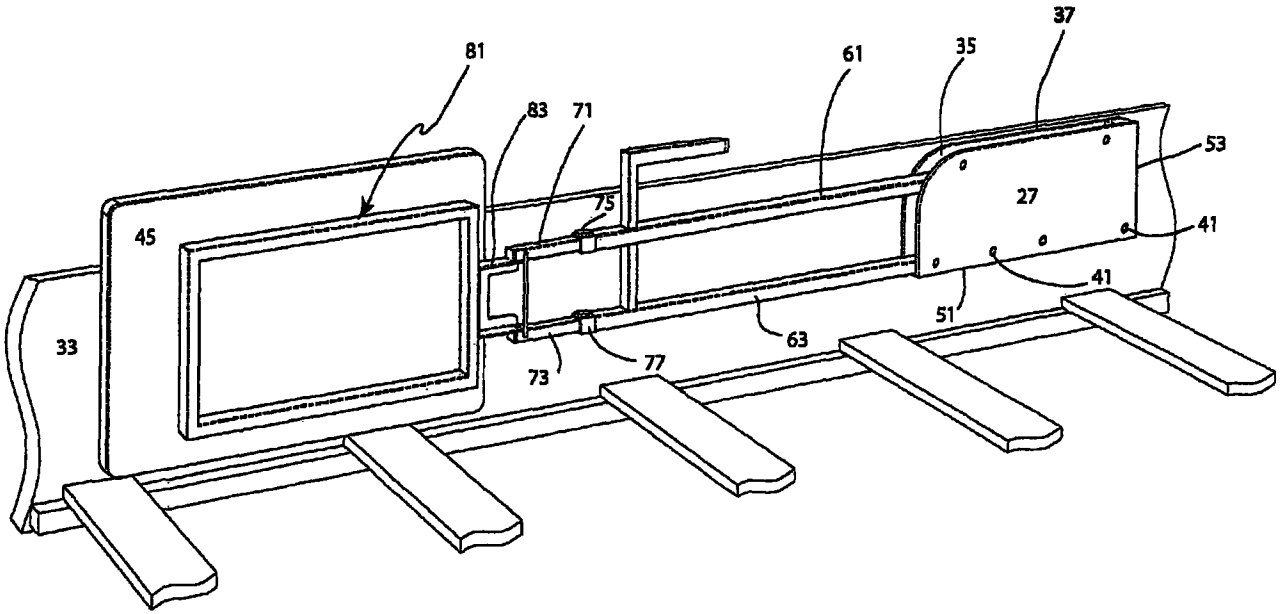
FIG. 5 is sectional view similar to FIG. 4 but with the table device in a partially raised position.

To be stored, the table will be rotated about the pivot pins 85 to its extended position co-extensive with the plane of the stand 21 as shown in FIG. 5 to be rotated downwardly along the inside surface 33 of the bed rail. When it is desirable to deploy the table top 45, the attendant will grasp the handle 80 to draw the stand 21 upwardly about the pivot pin 41 as the following opposite side of the stand traces a circular pattern within the box as supported against relative movement and flexing.

As noted, when the stand 21 is rotated to the vertical position shown in FIG. 3, it will be appreciated that the side walls 35 and 37 of the box afford rigid support for the lower portions of the stems 61 and 63 of the stand to provide support against torqueing and flexing relative to the box to thereby provide a positive and rigid support for the stand and, consequently, the table 45 as it is deployed to its horizontal position as shown in FIG. 1.

Then, as the table top 41 is loaded with materials, such as, for instance, a newspaper, drinking water, a breakfast meal and other possible weights such as photographs of loved ones and the like, the table top will be firmly supported by the stand 21 as constrained within the walls 35 and 37 of the box 27 and supported by the rigid underframe 81.

Figure 8:
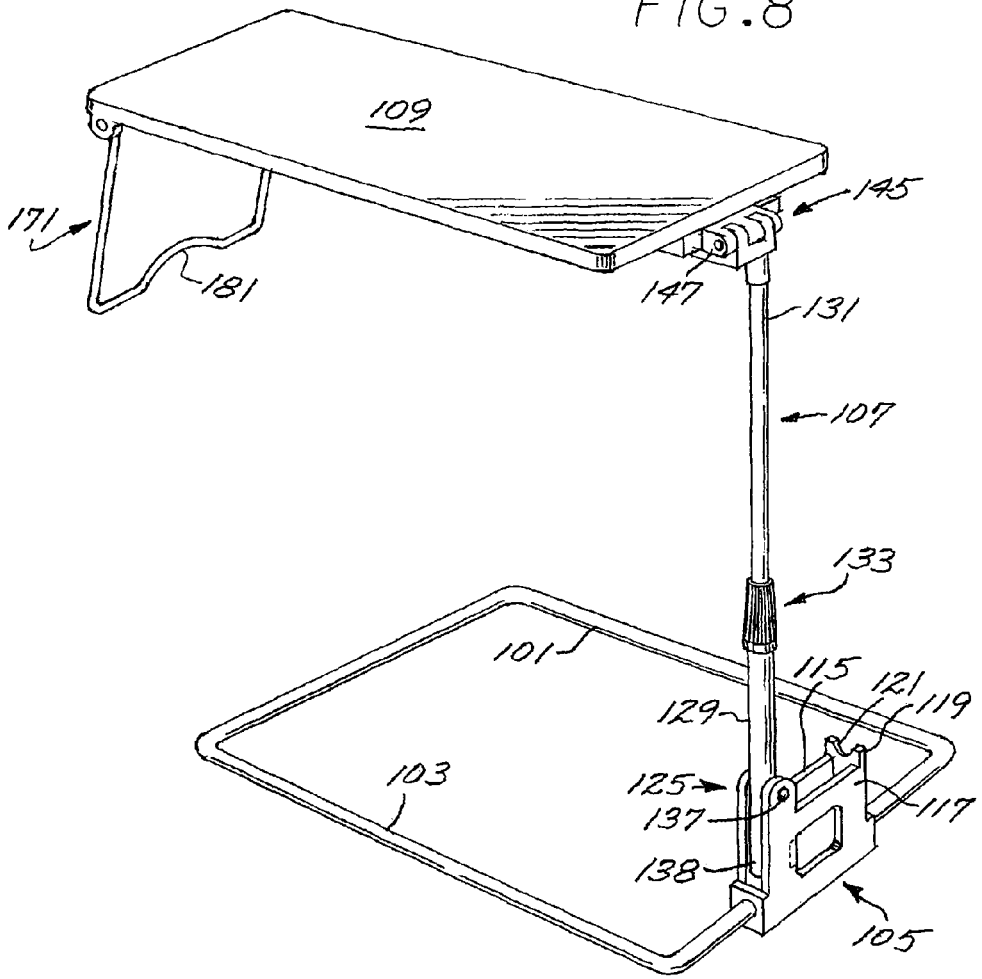
FIG. 8 is a partial perspective view of a second embodiment of the retractable table device of the present invention.

The embodiment of the retractable table device shown in FIGS. 8-17 is similar to that shown in FIG. 1 except that, the mounting device supporting the table is in the form of a horizontal base frame, generally designated 101 which, in the exemplary embodiment, is in the form of a rectangular tubular base 103. Mounted on one side of the frame 101 is a box in the form of an open top mounting cradle device, generally designated 105, which pivotally supports an elongated stem 107 having a table 109 pivotally mounted to the free extremity thereof for rotation between a retracted position projecting longitudinally in the extended plane including the stem to a working position perpendicular to the stem as shown in FIG. 8.

The supporting base frame 101 is conveniently constructed of a hollow tubing and is approximately eighteen 18 inches long and fourteen 14 inches wide. The mounting cradle 105 is constructed with a pair of parallel spaced apart side walls 115 and 117 to open on one end and closed on the opposite end by an end wall 119 configured with an upwardly opening semicircular nest 121. The side walls cooperate to form at the opposite end of the mounting device nest 121 with an upstanding yoke 125.

Figure 13:
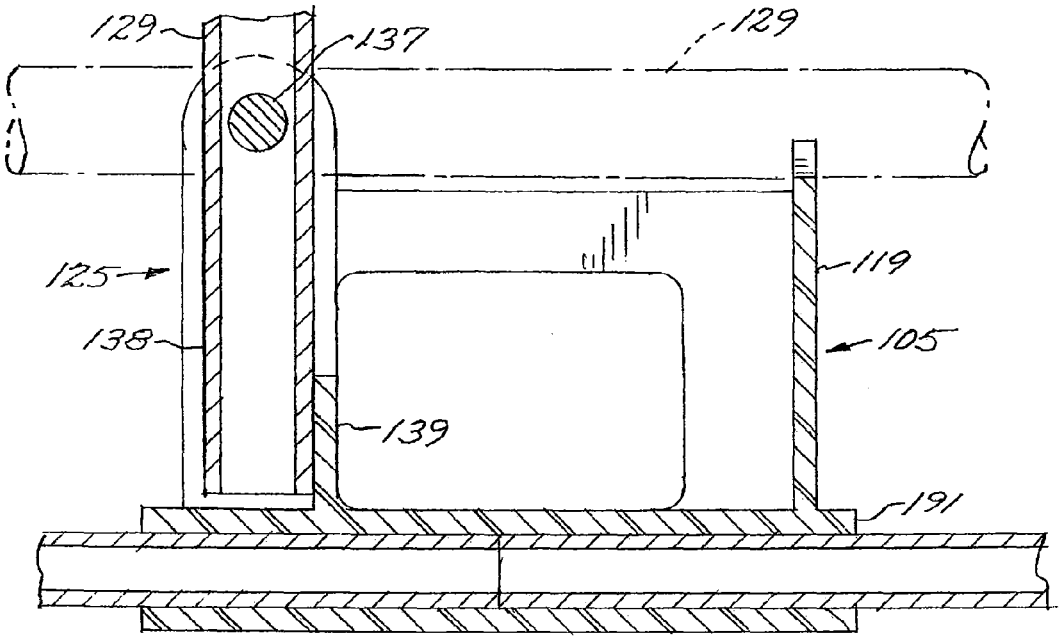
FIG. 13 is a partial vertical sectional view, in enlarged scale, taken through the mounting device incorporated in the retractable table device of FIG. 8.
Figure 17:
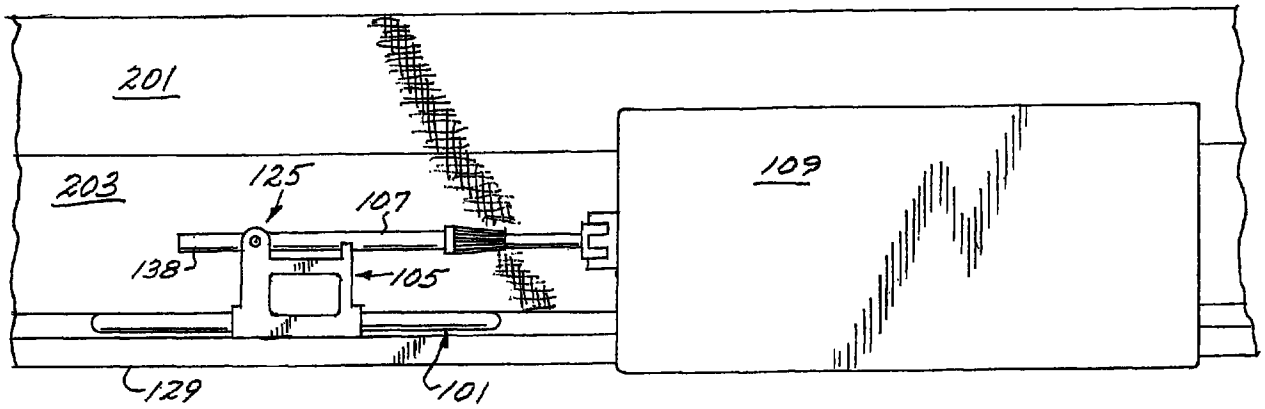
FIG. 17 is a side view of the table device shown in FIG. 8 and depicting the stem and table in its retracted position.

The stem 107 is configured with a female lower section 129 having a male upper section 131 telescoped downwardly thereinto and lock in position by a threaded friction adjustment device, generally designated 133. The lower extremity of the lower section 129 is received in the mounting box 105 and is connected medially to the yoke 125 by a horizontal pivot pin 137 to leave a follower 138 projecting below such pins as depicted in FIG. 13. The mounting box includes a vertical stop tab 139 to limit counterclockwise rotation of the stem 107 as viewed in FIG. 13. The stem 107 may thus be rotated from its vertical position shown in FIG. 13 to the broken line horizontal position with the medial portion of the lower section 129 received in the nest 121.

Figure 9:
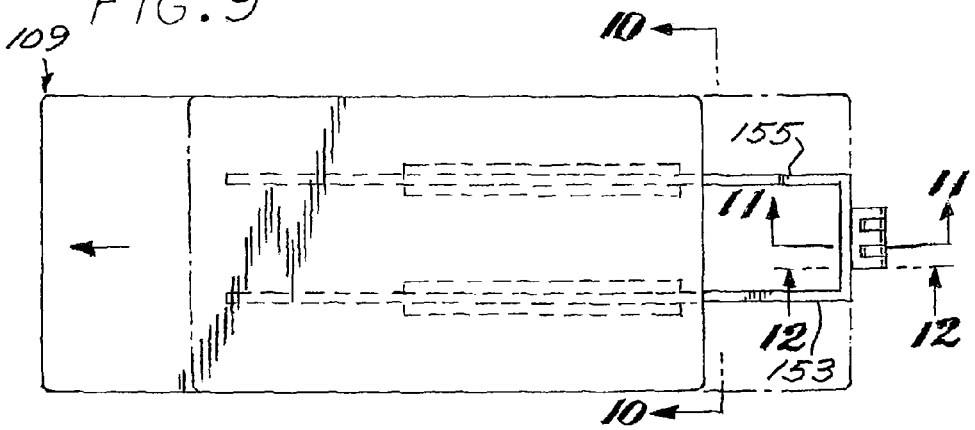
FIG. 9 is a top view of the retractable table device shown in FIG. 8 and depicting the table shiftable to an extended position relative to the stem.
Figure 10:
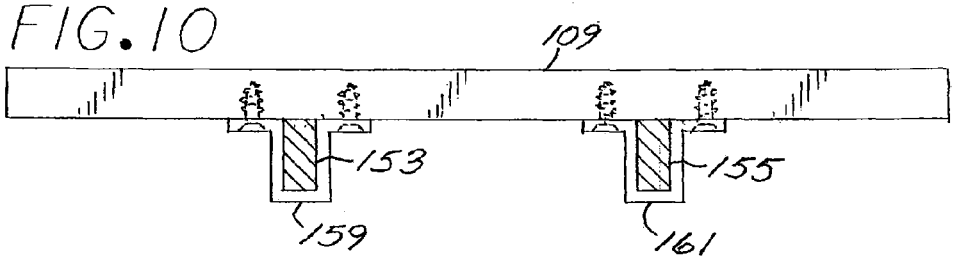
FIG. 10 is a transverse, sectional view, in enlarged scale, taken along the line 10-10 of FIG. 9.
Figure 11:
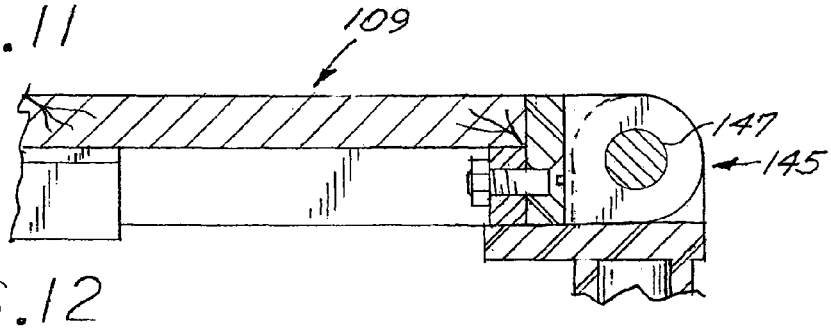
FIG. 11 is a partial vertical, sectional view, in enlarged scale, taken on the line 11-11 of FIG. 9.
Figure 12:
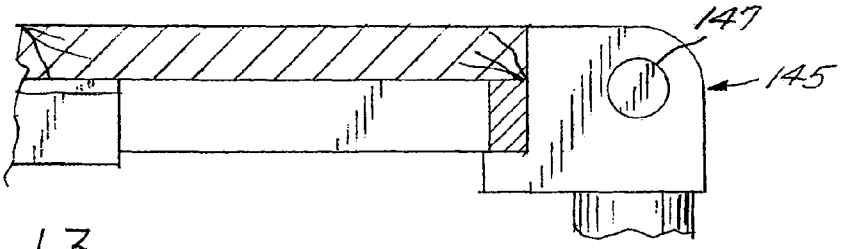
FIG. 12 is a partial vertical, sectional view, in enlarged scale, along line 5-5 of FIG. 9.

Referring to FIGS. 9, 11 and 12, supported from the free end of the stem 107 is a hinge, generally designated 145, for pivotal support of the table 109 to be rotated about a hinge pin 147. Carried from the hinge is a yoke, generally designated 151 (FIG. 14), formed with a pair of tines defining respective parallel sliders 153 and 155. Mounted on the underside of the table are a pair of channel tracks 159 and 161 (FIGS. 10 and 14) which slide along the sliders 153 and 155 to adjust the table from the retracted broken line position shown in FIG. 9 to the extended solid line position.

Referring to FIG. 14, mounted to the underside of the free end of the table are a pair of ears 167 and 169 disposed on opposite sides thereof. A strut in the form of a wire bale, generally designated 171, is formed with an open end having out-turned pivot tabs 173 and 175 received in the ears 167 and 169. The bale 171 is formed centrally with an arcuate section 181 which, in its retracted position, is snapped into a resilient clip 187.

In operation, it will be appreciated that the mounting box 105 may be formed in its lower portion with an open ended receiver tube 191 (FIG. 13) for receiving the opposite ends of the tube defining the support device 101. In that manner, the device may be disassembled for shipment and reassembled by the attendant prior to use.

Figure 4:
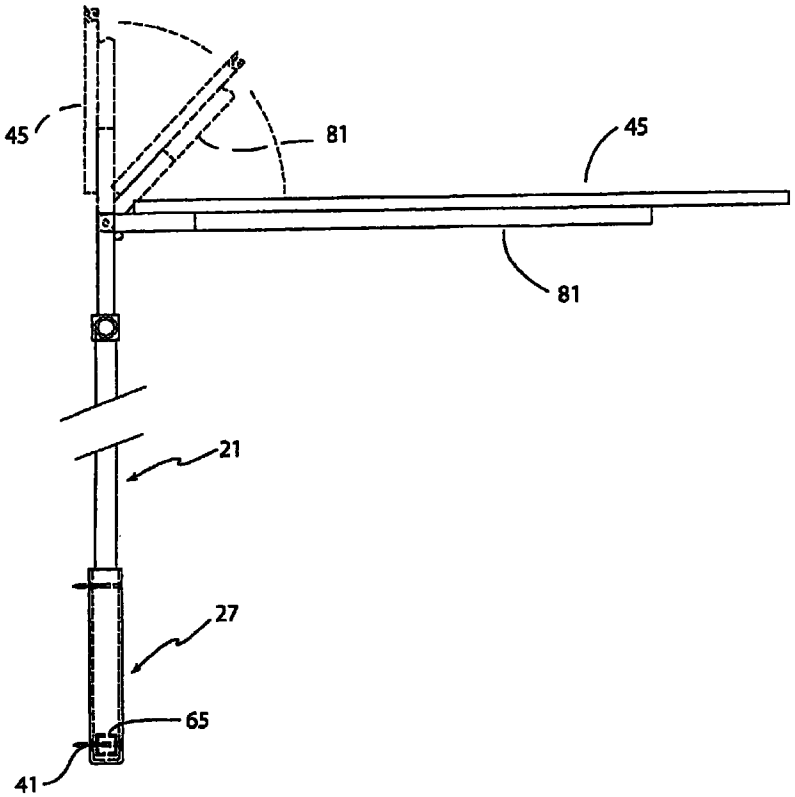
FIG. 4 is a sectional view, in enlarged scale, taken from inside a rail of a bed similar to a bed similar to FIG. 1 but with the table device reversed relative to the position shown in FIG. 1.

In any event, when it is desirable to use the retractable table of the present invention, the user may lift the mattress 201 or sofa cushion or the like (FIG. 16) to raise the mattress and innerspring 203 off the bed frame 205 to insert the base frame 101 over the frame 205. The mattress or cushion or the like may be then lowered to trap the base frame 101 in place. When the patient is then sitting or lying in the bed, the weight of the patient will help to trap the support 101 in place and stabilize it against rocking forwardly or rearwardly or laterally. It will be appreciated that the table 109 will normally be pivoted to its retracted position projecting in the extended plane including the stem 107 as shown in FIG. 4. The medial portion of the lower section 129 of the stem will be supported in the nest 121 to support such a table from lowering onto the floor and coming into contact with debris or residue which might have collected on such floor.

When it is desirable to use the tray, the attendant may merely grasp the edge of the tray (FIG. 17) and raise it upwardly in the counterclockwise direction as shown in FIG. 16 until the follower 138 abuts the stop tab 139 (FIG. 13) to limit further rotation in the counterclockwise direction. The free end of the table may then be lowered to the working position projecting perpendicular to the plane of the stem 107 as shown in FIG. 8. The free end of the bale 171 may be detached from the clip 187 and lowered to the position shown in FIG. 8 to provide support on the bed.

The table may then be drawn outwardly in the direction of the directional arrow 211 in FIG. 9 to draw the channels 159 and 161 outwardly on the tracks 153 and 155 to the extended position more centered over the bed for convenient use by the patient.

The table 109 will then be firmly supported in the position at the hinge end of the table to carry the load on the table and resist rocking of the stem 131 in either the lateral directions or forwardly and rearwardly relative to the head of the bed.

From the foregoing it will be appreciated that the retrofit table device of the present invention provides an economical and convenient means for installing a table device adjacent a bed for convenient storage and deployment to provide sturdy support for loads of various sizes and weights.

Although the present invention has been described in detail with regard to the preferred embodiments and drawings thereof, it should be apparent to those of ordinary skill in the art that various adaptations and modifications of the present invention may be accomplished without departing from the spirit and the scope of the invention. Accordingly, it is to be understood that the detailed description and the accompanying drawings as set forth hereinabove are not intended to limit the breadth of the present invention.

I claim:

1. A retractable table device for mounting in a narrow space between the side of a mattress device on a bed frame rail, and comprising:

a horizontal, laterally projecting base device to be sandwiched between the frame and the mattress device;

an elongated stem device for mounting on one extremity thereof from the base device for rotation from a horizontal, retracted position disposed in the space to a vertical position and terminating in a free upper extremity;

a pivot device rigidly mounted to the base device and mounting the one extremity from the base device for pivoting of the stem device about a single axis transverse to the length of the narrow space;

a table formed with one end for mounting to the upper free extremity and pivotable between a retracted position disposed in the plane of the stem device and a working position perpendicular to the plane of the stem device;

a hinge mounting the table to the free upper extremity;

a support device for supporting the table in the working position.

2. The retractable table device of claim 1 wherein:

the stem device is in the form of an elongated tube device.

3. The retractable table device of claim 1 wherein:

the stem device includes an adjustment device for adjusting the length of the stem device.

4. The retractable bed table device of claim 1 wherein:

the stem device is linear and the hinge is interposed between the free upper extremity and table for rotation of the table to the retracted position projecting along the same plane as the stem device.

5. A retractable bed table device for fitting in the narrow space between the side of a mattress device and a bed side rail comprising:

an elongated stem device constructed for positioning in the space, having top and bottom extremities, formed medially with a pivot axis and projecting downwardly beyond the pivot axis to form a follower constructed to travel through a selected path from a downward retracted position to an erect elevated position;

a laterally projecting base device to be interposed between the mattress device and a supporting frame;

a mounting box on the base device for fitting in the space and having opposite side walls configured to fit the bottom extremity of the stem device and follower in close fit relationship to provide for rotation of the stem device through the predetermined path and for restraining the stem device against rotation in the plane including the pivot axis;

a pivot device connecting the pivot axis of the stem device to the mounting box;

the mounting box including first and second stops, the first stop disposed in the predetermined path to, when the stem device is rotated in one direction to the erect position, be engaged by the follower to stop the rotation in the one direction and the second stop being disposed in the path to, when the stem device is rotated in the direction opposite the one direction, be engaged to support the stem device in the retracted position; and a table pivotally connected to the top extremity for pivoting between a retracted position disposed in the plane including the stem device and a working position disposed perpendicular to the plane.

6. The retractable bed table device of claim 5 wherein:

the mounting box includes a bottom wall supporting a vertical tab forming the second stop positioned to be engaged by the follower.

7. A retractable table device for mounting to fit in a narrow space between the side of a mattress device on a bed frame and a rail of a bed and comprising:

a horizontal, laterally projecting base device to be sandwiched between the frame and the mattress device;

an elongated stem device for mounting on one extremity thereof from the base device for rotation from a horizontal, retracted position disposed in the space to a vertical position and terminating in a free upper extremity;

a pivot device rigidly mounted to the base device and mounting the one extremity from the base device for pivoting of the stem device about a single axis transverse to the length of the narrow space;

a table formed with one end for mounting to the upper free extremity and pivotable between a retracted position disposed in the plane of the stem device and a working position perpendicular to the plane of the stem device;

a hinge mounting the table to the free upper extremity;

a support device for supporting the table in the working position including a bale carried pivotally from a free end of the table for shifting between a retracted position on the underside of the table to a supporting position to support the free end.

8. A retractable table device for mounting to fit in a narrow space between the side of a mattress device on a bed frame and a rail of a bed and comprising:

a horizontal, laterally projecting base device to be sandwiched between the frame and the mattress device;

an elongated stem device for mounting on one extremity thereof from the base device for rotation from a horizontal, retracted position disposed in the space to a vertical position and terminating in a free upper extremity;

a pivot device rigidly mounted to the base device and mounting the one extremity from the base device for pivoting of the stem device about a single axis transverse to the length of the narrow space;

a table formed with one end for mounting to the upper free extremity and pivotable between a retracted position disposed in the plane of the stem and device a working position perpendicular to the plane of the stem device;

a hinge mounting the table to the free upper extremity;

a support device for supporting the table in the working position including a bale pivotally supported from a free end of the table.

9. The retractable table device of claim 8 that includes:

a track and slider device connecting the table with the stem device for extension of the table to an extended working position.

10. The retractable table device of claim 8 wherein:

the base device includes tubing configured in a quadrangle.

11. The retractable table device of claim 10 wherein:

the tubing is in the form of a rectangle greater than one foot long.

12. The retractable table device of claim 8 that includes:

a track device interposed between the stem device and table to provide for shifting the table relative to the stem device.

13. A retractable table device for mounting to fit in a narrow space between the side of a mattress device on a bed frame and a rail of a bed and comprising:

a horizontal, laterally projecting base device to be sandwiched between the frame and the mattress device;

an elongated stem device for mounting on one extremity thereof from the base device for rotation from a horizontal, retracted position disposed in the space to a vertical position and terminating in a free upper extremity;

a pivot device rigidly mounted to the base device and mounting the one extremity from the base device for pivoting of the stem device about a single axis transverse to the length of the narrow space;

a table formed with one end for mounting to the upper free extremity and pivotable between a retracted position disposed in the plane of the stem device and a working position perpendicular to the plane of the stem device;

a hinge mounting the table to the free upper extremity;

a support device for supporting the table in the working position including a mounting bracket carried from the base device including a yoke and a cradle spaced from the yoke and a pivot pin connecting the stem device to the yoke for pivoting of the stem device to be medially nested in the cradle.

* * * * *